US006754925B1

(12) United States Patent
Wang

(10) Patent No.: US 6,754,925 B1
(45) Date of Patent: Jun. 29, 2004

(54) INFLATABLE BED

(76) Inventor: Cheng-Chung Wang, 12F, No. 440, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 10/331,913

(22) Filed: Dec. 30, 2002

(51) Int. Cl.[7] ..... A47C 27/08; A47C 27/10
(52) U.S. Cl. ..... 5/706; 5/710
(58) Field of Search ..... 5/706, 710

(56) References Cited

U.S. PATENT DOCUMENTS 3,147,496 A * 9/1964 Mendoza ..... 5/706

6,618,884 B1 * 9/2003 Wu ..... 5/706

* cited by examiner

*Primary Examiner*—Alexander Grosz
(74) *Attorney, Agent, or Firm*—Alan D. Kamrath; Nikolai & Mersereau, P.A.

(57) ABSTRACT

An inflatable bed has a primary bed and a supporting rim securely connected to an outer contour of the primary bed. The primary bed has an extension integrally extending from sides of the primary bed to securely engage with an outer surface of the supporting rim so as to limit movement of the supporting rim. After a load is placed on top of the primary bed, the overall appearance of the inflatable bed is maintained and the movement of the supporting rim is limited.

3 Claims, 8 Drawing Sheets

INFLATABLE BED

BACKGROUND OF THE INVENTION

1. Field of the Invention

The present invention relates to an inflatable bed, and more particularly to an inflatable bed which is able to support a load thereon and maintain the integral shape without deformation on opposite sides of the bed.

2. Description of Related Art

Inflatable beds have been used for years by many families all over the world. The biggest advantage of the inflatable bed is its maneuverability such that the user may set up an inflatable bed almost any time at any place.

With reference to FIGS. 4 and 5, a conventional inflatable bed comprises a primary bed (1) and a supporting bed (2). The primary bed (1) has multiple air chambers (10) integrally connected with one another in series. The supporting bed (2) also has multiple chambers (20) integrally connected to a bottom of the primary bed (1).

Through an inflation device, the inflatable bed is ready for use. However, when the supporting bed (2) is inflated, each of the chambers (20) become cylindrical such that when there is a road on top of the primary bed (1), opposite sides of the supporting bed (2) respectively move outward and deform to spoil the overall appearance of the inflatable bed.

To overcome the shortcomings, the present invention tends to provide an improved inflatable bed to mitigate and obviate the aforementioned problems.

SUMMARY OF THE INVENTION

The primary objective of the present invention is to provide an improved inflatable bed which is able to maintain the overall appearance even when there is a load on top of the inflatable bed.

Another objective of the present invention is to provide an improved inflatable bed composed of a primary bed and a supporting bed. The primary bed has two extensions respectively extending from two sides of the primary bed to engage with the supporting bed respectively so that structurally the supporting bed is integral to the primary bed and thus deformation of the inflatable bed is avoided.

Other objects, advantages and novel features of the invention will become more apparent from the following detailed description when taken in conjunction with the accompanying drawings.

DETAILED DESCRIPTION OF THE PREFERRED EMBODIMENT

Figure 1:
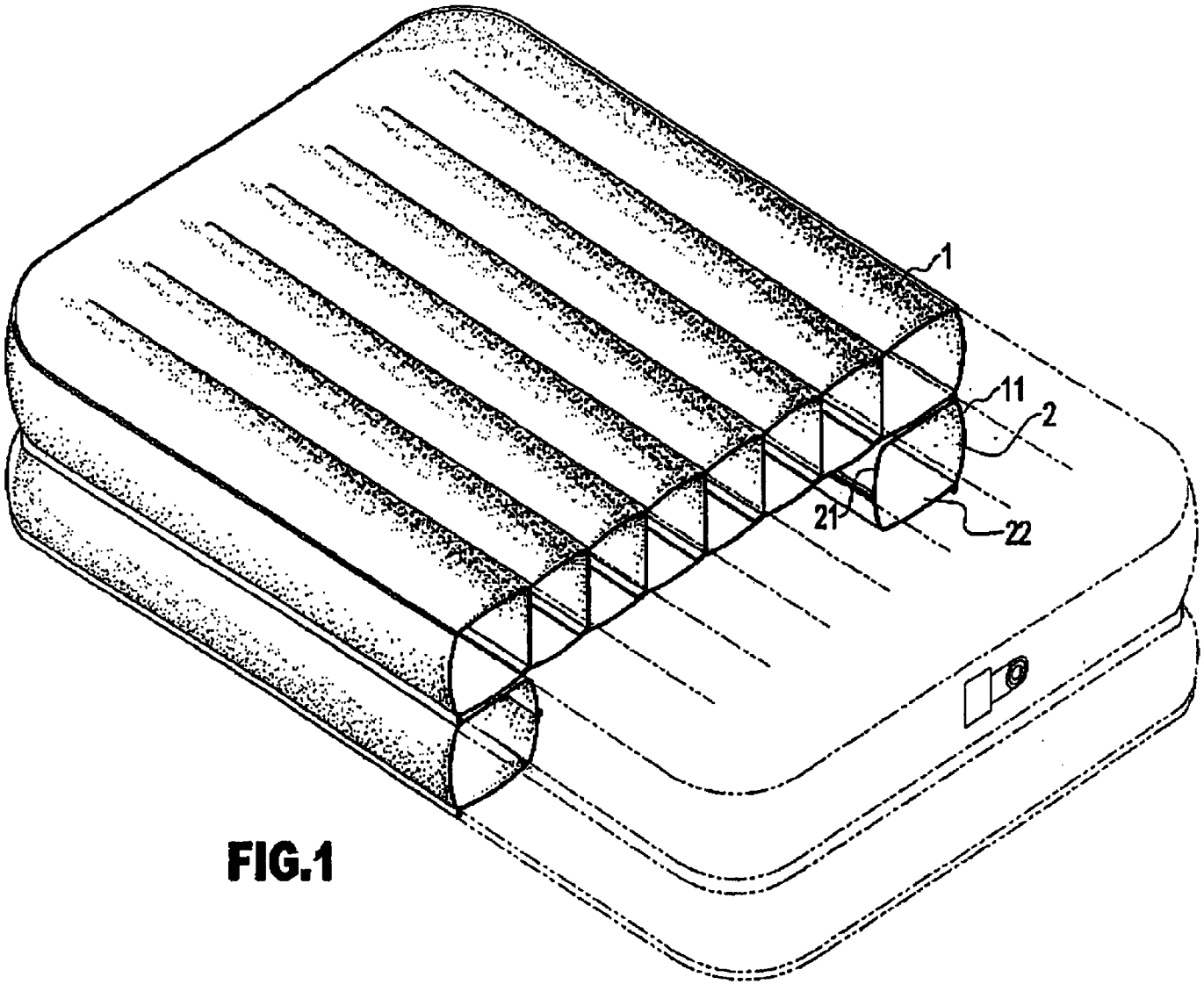
FIG. 1 is a perspective view of the inflatable bed of the present invention.
Figure 2:
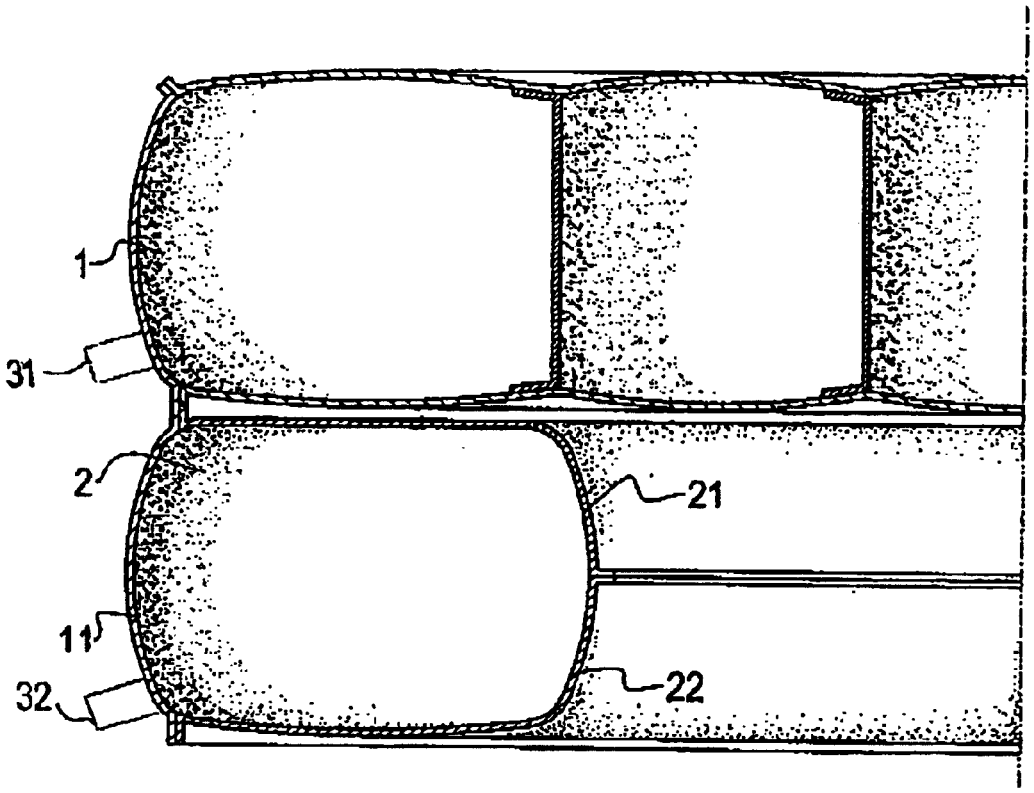
FIG. 2 is a cross sectional view of the inflatable bed in FIG. 1.

With reference to FIGS. 1 and 2, the inflatable bed in accordance with the present invention has a primary bed (1) and a supporting rim (2) securely connected to an outer contour of the primary bed (1).

The primary bed (1) has an extension (11) extending from all sides of the primary bed (1). The supporting rim (2) is composed of a first foil (21) and a second foil (22) securely connected to the first foil (21). The supporting rim is securely connected to the outer contour of the primary bed (1) and the supporting rim is hollow in the central portion thereof.

The extension (11) is securely engaged with an end side of the second foil (22) so as to form the supporting rim (2). Due to the engagement of the extension (11) to the second foil (22), movement of the supporting rim (2) is limited. The primary bed (1) may be inflated by a valve 31 and the supporting rim (2) may be inflated by a valve 32, as diagrammatically shown on FIG. 2.

Figure 3:
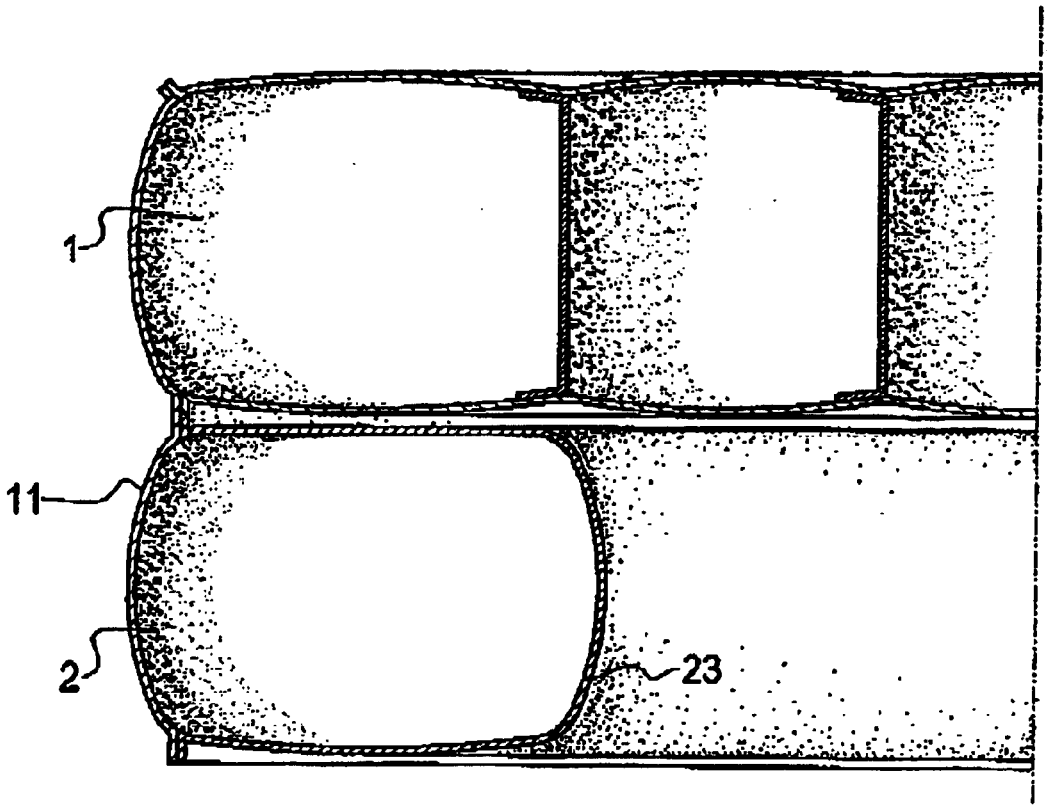
FIG. 3 is a cross sectional view of a second embodiment of the inflatable bed of the present invention.
Figure 4:
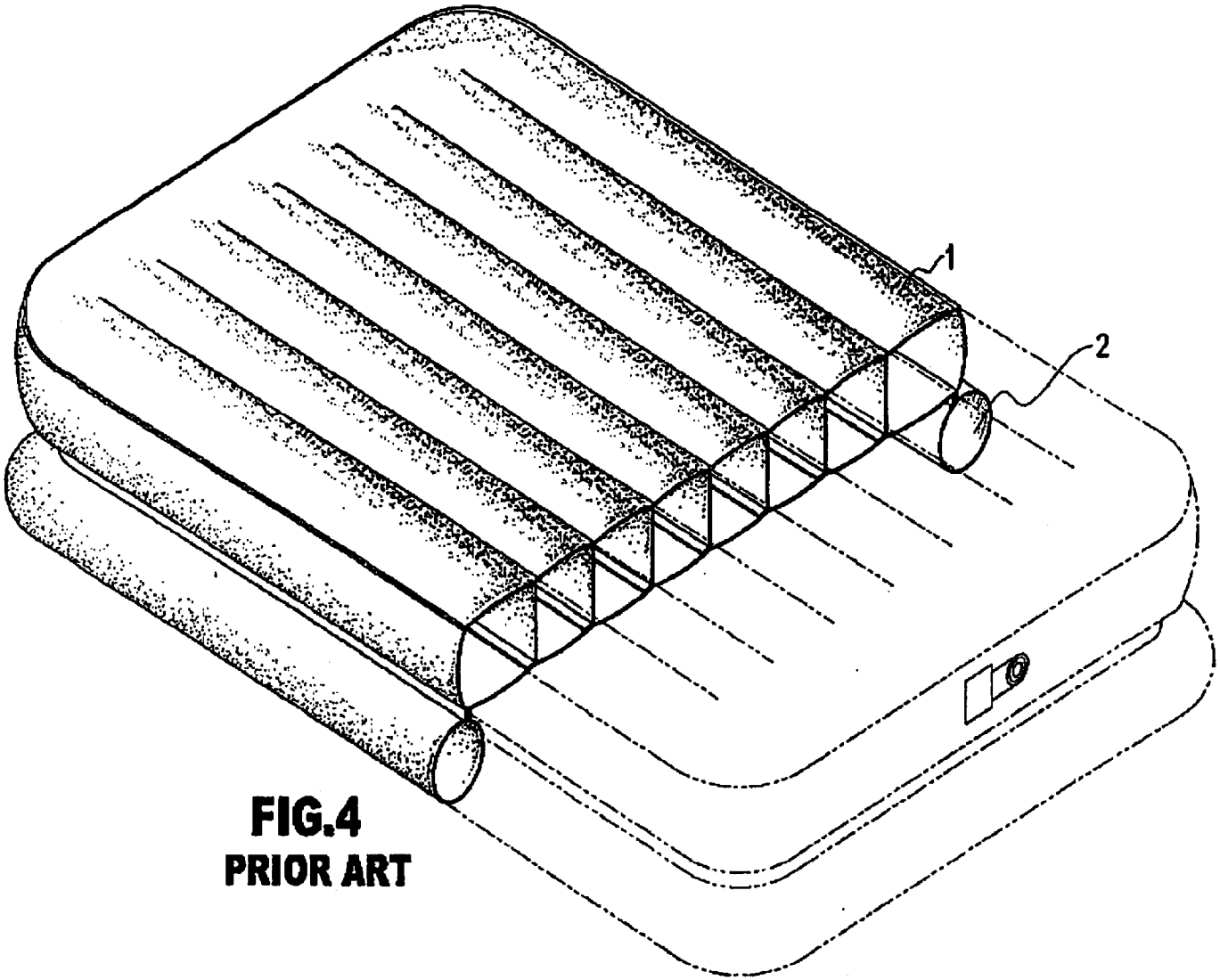
FIG.4 PRIOR ART
FIG. 4 is a perspective view of a conventional inflatable bed.
Figure 5:
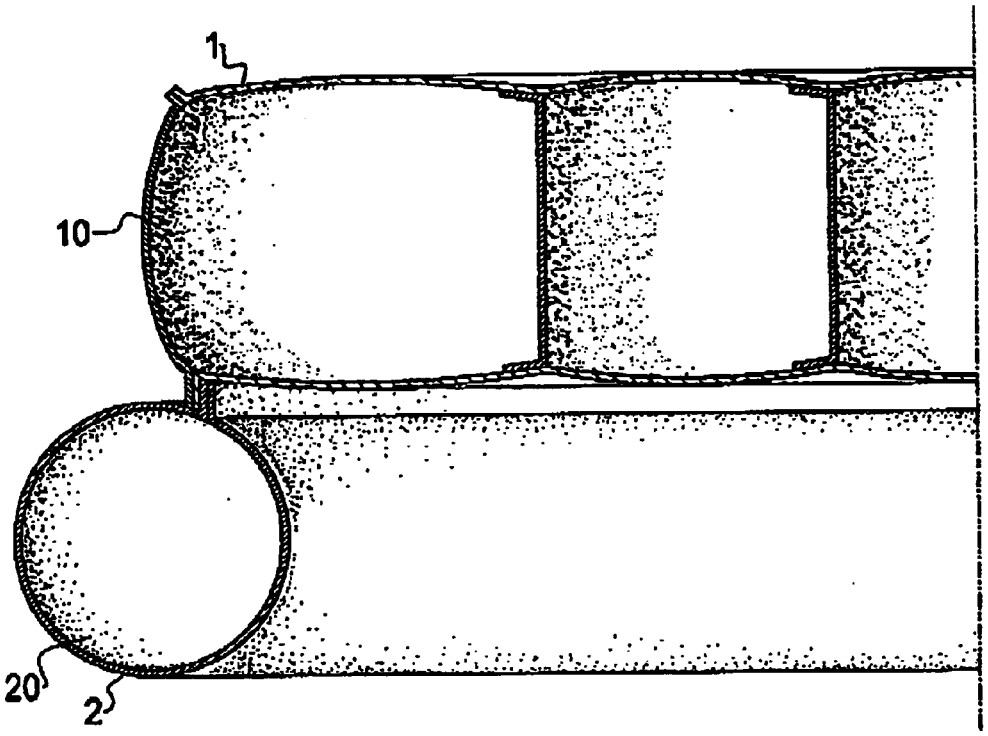
FIG.5 PRIOR ART
FIG. 5 is a cross sectional view of the conventional inflatable bed in FIG. 4.
Figure 6:
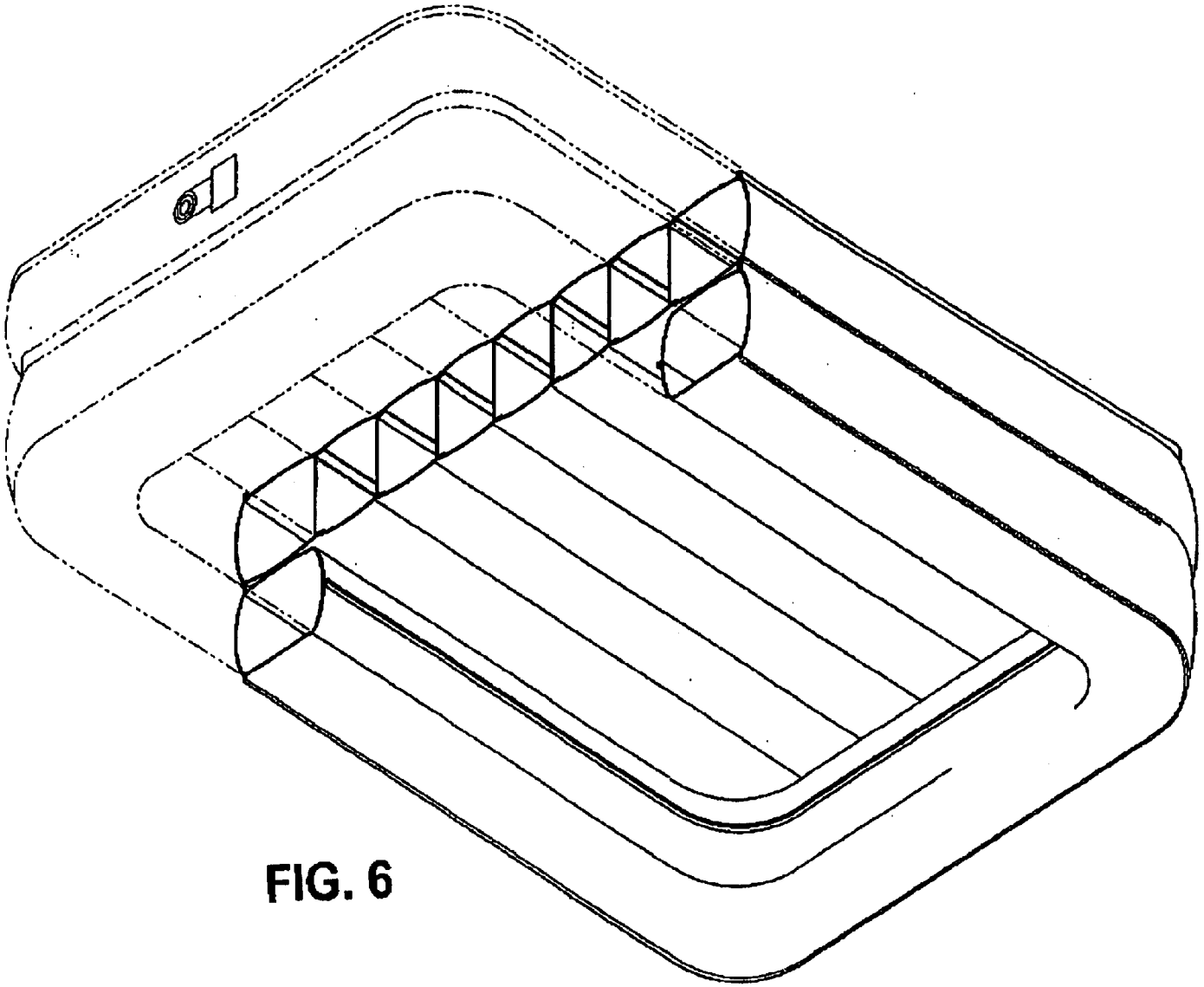
FIG. 6 is a bottom perspective view of the inflatable bed of the present invention.
Figure 7:
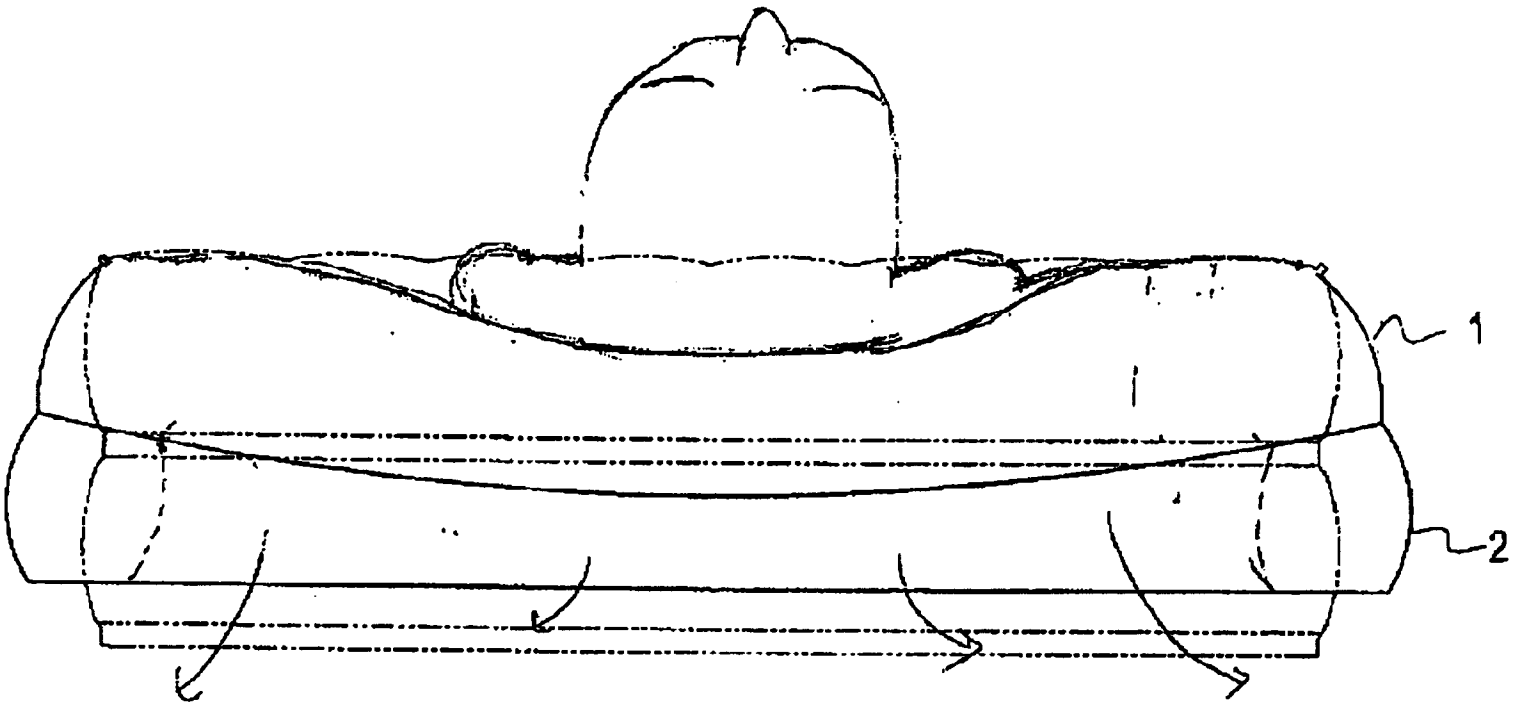
FIG. 7 is a side view of the inflatable bed of the present invention having a load.
Figure 8:
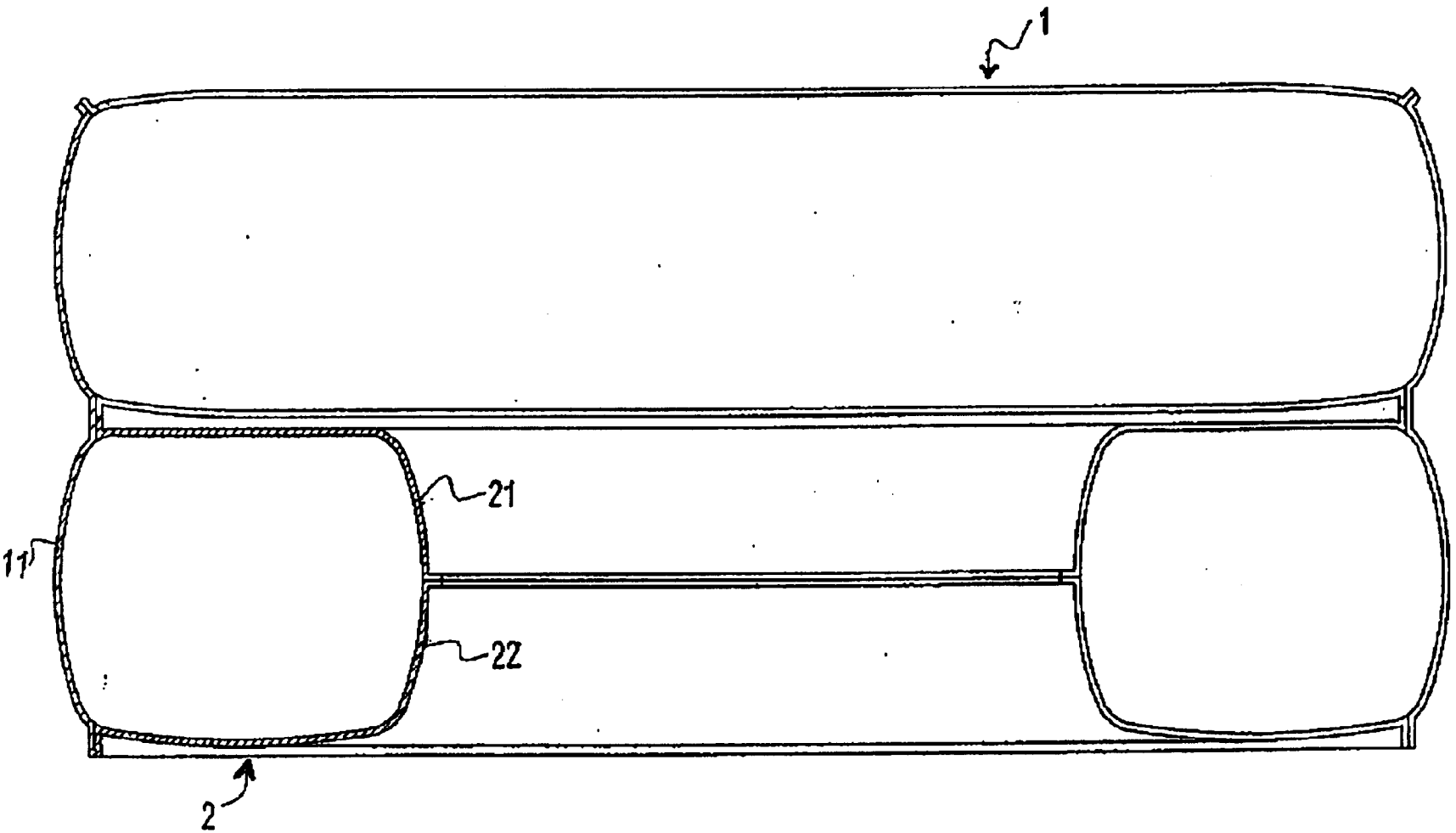
FIG. 8 is a longitudinal cross-sectional view of tie inflatable bed of the present invention.

With reference to FIG. 3, it is noted from another embodiment of the present invention that the extension (11) may be securely connected to a foil (23) to form the supporting rim (2).

With such an arrangement, it is concluded that because the extension (11) securely engages with the outer surface of the second foil (22) or the foil (23), movement of the supporting rim (2) is limited and the overall appearance of the inflatable bed is maintained even after a load, i.e. a user, is laid on top of the primary bed (1).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an inflatable bed having an inflatable primary bed and a supporting rim securely connected to an outer contour of the inflatable primary bed, with the supporting rim being hollow in a central portion of the supporting rim, wherein the improvements comprise:

the inflatable primary bed bas an extension formed to extend from sides of the inflatable primary bed to securely engage with an outer surface of the supporting rim so as to limit movement of the supporting rim, whereby after a load is on top of the inflatable primary bed, overall appearance of the inflatable bed is maintained and the movement of the supporting rim is limited.

2. The inflatable bed as claimed in claim 1, wherein the supporting rim is composed of multiple foils and the extension so as to form the supporting rim.

3. The inflatable bed as claimed in claim 1, wherein the extension extending down from sides of the inflatable primary bed to securely connect to an end side of a foil to form the supporting rim.

* * * * *